US008312913B2

(12) United States Patent
Gervasi et al.

(10) Patent No.: US 8,312,913 B2
(45) Date of Patent: Nov. 20, 2012

(54) CASTING PROCESS

(75) Inventors: Vito R. Gervasi, New Berlin, WI (US); Adam J. Schneider, Howards Grove, WI (US); Josh Rocholl, Brooklyn, WI (US); Doug C. Stahl, Shorewood, WI (US)

(73) Assignee: Milwaukee School of Engineering, Milwaukee, WI (US)

( * ) Notice: Subject to any disclaimer, the term of this patent is extended or adjusted under 35 U.S.C. 154(b) by 462 days.

(21) Appl. No.: 11/359,084

(22) Filed: Feb. 22, 2006

(65) Prior Publication Data

US 2007/0035066 A1 Feb. 15, 2007

Related U.S. Application Data

(60) Provisional application No. 60/655,127, filed on Feb. 22, 2005.

(51) Int. Cl.
*B22D 18/04* (2006.01)
*B22D 18/06* (2006.01)
*B22C 3/00* (2006.01)

(52) U.S. Cl. ..... 164/63; 164/72; 164/119

(58) Field of Classification Search ..... 164/72, 164/119, 114, 7.1, 66.1, 259, 267, 63, 255, 164/306

See application file for complete search history.

(56) References Cited

U.S. PATENT DOCUMENTS 3,863,706 A 2/1975 Chandley et al.
3,900,064 A 8/1975 Chandley et al.
4,340,108 A 7/1982 Chandley et al.
4,422,984 A * 12/1983 Neefe ..... 264/2.1
4,616,691 A 10/1986 Voss
4,641,703 A 2/1987 Voss et al.
4,658,880 A 4/1987 Voss
4,791,977 A 12/1988 Chandley
4,809,767 A 3/1989 Voss et al.
4,825,933 A 5/1989 Voss et al.
4,828,011 A 5/1989 Hafer et al.
4,848,439 A 7/1989 Plant
4,858,672 A 8/1989 Chandley
4,862,945 A 9/1989 Greanias et al.
4,862,946 A 9/1989 Chandley (Continued)

FOREIGN PATENT DOCUMENTS

JP 1040162 A 2/1989

(Continued)

OTHER PUBLICATIONS

PCT/US06/06164 International Search Report dated Oct. 30, 2007.

*Primary Examiner* — Kevin P Kerns
(74) *Attorney, Agent, or Firm* — Michael Best & Friedrich LLP

(57) ABSTRACT

A method of casting including coating at least a portion of a mold with a non-porous coating, placing the mold in a chamber capable of inducing pressure, and applying pressure to the chamber to press material into a cavity in the mold. Another method of casting including coating at least a portion of a mold with a non-porous coating, placing a first fill tube in a material, applying a vacuum to a second fill tube to establish a vacuum within the non-porous coating, and allowing atmospheric pressure to inject the material into the mold without placing the mold in a chamber capable of inducing pressure.

50 Claims, 1 Drawing Sheet

U.S. PATENT DOCUMENTS

| | | | | | |
|---|---|---|---|---|---|
| 4,865,113 | A | | 9/1989 | Voss et al. | |
| 4,889,177 | A | * | 12/1989 | Charbonnier et al. | 164/97 |
| 4,932,461 | A | | 6/1990 | Schaffer et al. | |
| 4,951,852 | A | | 8/1990 | Rancoulle | |
| 4,957,153 | A | | 9/1990 | Chandley | |
| 4,961,455 | A | | 10/1990 | Redemske et al. | |
| 4,971,131 | A | * | 11/1990 | Aubin et al. | 164/7.1 |
| 5,042,561 | A | | 8/1991 | Chandley | |
| 5,070,930 | A | | 12/1991 | Kubisch et al. | |
| 5,088,546 | A | | 2/1992 | Greanias et al. | |
| 5,146,973 | A | | 9/1992 | Chandley | |
| 5,161,604 | A | | 11/1992 | Chandley et al. | |
| 5,178,203 | A | | 1/1993 | Kuhn et al. | |
| 5,205,346 | A | | 4/1993 | Kuhn et al. | |
| 5,215,141 | A | | 6/1993 | Kuhn et al. | |
| 5,230,379 | A | | 7/1993 | Voss | |
| 5,271,451 | A | | 12/1993 | Chandley et al. | |
| 5,299,619 | A | * | 4/1994 | Chandley et al. | 164/53 |
| 5,303,762 | A | | 4/1994 | Chandley | |
| 5,468,358 | A | * | 11/1995 | Ohkawa et al. | 204/487 |
| 5,658,506 | A | * | 8/1997 | White et al. | 264/28 |
| 5,948,352 | A | | 9/1999 | Vender Jagt et al. | |
| 6,004,368 | A | | 12/1999 | Chandley et al. | |
| 6,453,976 | B1 | | 9/2002 | Chandley et al. | |
| 6,499,529 | B1 | * | 12/2002 | Farkas | 164/114 |
| 6,640,877 | B2 | * | 11/2003 | Soderstrom et al. | 164/122.1 |
| 6,684,934 | B1 | * | 2/2004 | Cargill et al. | 164/119 |
| 2003/0134045 | A1 | | 7/2003 | Mazzanti et al. | |

FOREIGN PATENT DOCUMENTS

| | | | |
|---|---|---|---|
| JP | 1317674 | A | 12/1989 |
| JP | 2099258 | A | 4/1990 |
| JP | 2104460 | A | 4/1990 |
| JP | 2104461 | A | 4/1990 |
| JP | 2303649 | A | 12/1990 |
| JP | 3042162 | A | 2/1991 |
| JP | 3094953 | A | 4/1991 |
| JP | 3216259 | A | 9/1991 |
| JP | 4220154 | A | 8/1992 |
| JP | 4220155 | A | 8/1992 |
| JP | 4224070 | A | 8/1992 |
| JP | 4231162 | A | 8/1992 |
| JP | 4270024 | A | 9/1992 |
| JP | 6000622 | A | 1/1994 |
| JP | 6031431 | A | 2/1994 |

* cited by examiner

CASTING PROCESS

RELATED APPLICATIONS

This application claims the benefit of the filing date of U.S. Provisional Patent Application No. 60/655,127 filed on Feb. 22, 2005, which is incorporated herein by reference in its entirety.

BACKGROUND

A conventional process called the Hitchiner counter gravity casting process provides a means to reduce gas defects in casts by sealing an investment tree within a vacuum chamber with a suction tube protruding from within the chamber. A metal suction tube is placed into molten metal and metal is pressed up into the mold void by atmospheric pressure. However, this conventional process required that ceramic molds be designed to withstand the pressure of the injected metal, otherwise ceramic mold shell failure would result. During a ceramic mold failure, a large transfer of liquid metal into the chamber (the chamber is capable of pressure and vacuum) would be difficult to avoid. Also, this conventional process is limited to pressures approaching one atmosphere of pressure gradient. In addition, features smaller than 0.5 mm present a challenge.

Another conventional Hitchiner casting process called Pneucast employs a chamber capable of high pressure (e.g., up to about 2500 PSI) and a mold positioned at the bottom of the chamber. After metal is introduced, high pressure is applied and the resulting castings have reduced porosity and higher strength. However, the chamber setup is not simple and a chamber may be lost for each casting. Also, the ceramic mold may not have a uniform distribution of pressure, and regions of tension result in the ceramic mold cracking. If the ceramic mold cracks, metal can also escape the mold cavity creating flash and potentially bonding to and/or damaging the chamber. In addition, the vacuum applied to the ceramic mold may not be of sufficient quality as molten metal is poured into the chamber.

Still another conventional method for making metal matrix composites uses a similar process to the high pressure Hitchiner process. Similar problems to the Hitchiner process are likely. Yet another method of applying pressure to a casting is centrifugal casting, which is conventionally used for jewelry. The centrifugal casting method results in the violent introduction of metal into the mold. Also, the ceramic mold is under tension during casting. In addition, thick-walled molds can lead to problems in cooling and applying a vacuum can present problems.

Most conventional metal casting processes are performed under conditions resulting in tension within the mold material. Well known to foundries, tension in ceramic or sand molds is not ideal, and must be minimized to ensure mold survival just long enough for the metal void to be captured.

SUMMARY

In one embodiment, the invention provides a method of casting including coating at least a portion of a mold with a non-porous coating, placing the mold in a chamber capable of inducing pressure, and applying pressure to the chamber to press material into a cavity in the mold.

Another embodiment of the invention provides a method of casting including coating at least a portion of a mold with a non-porous coating, placing a first fill tube in a material, applying a vacuum to a second fill tube to establish a vacuum within the non-porous coating, and allowing atmospheric pressure to inject the material into the mold without placing the mold in a chamber capable of inducing pressure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1B:
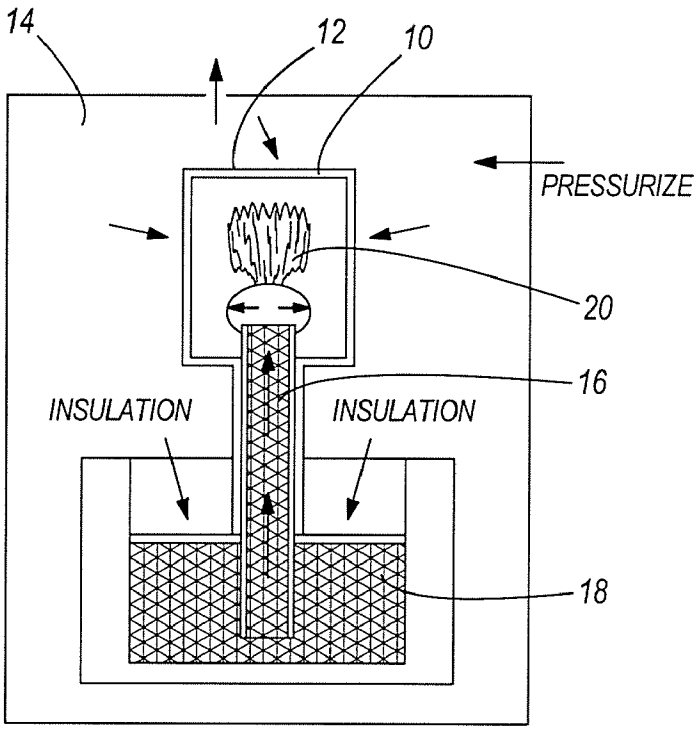
FIGS. 1A and 1B are schematic illustrations of a casting process according to one embodiment of the invention.
Figure 1A:
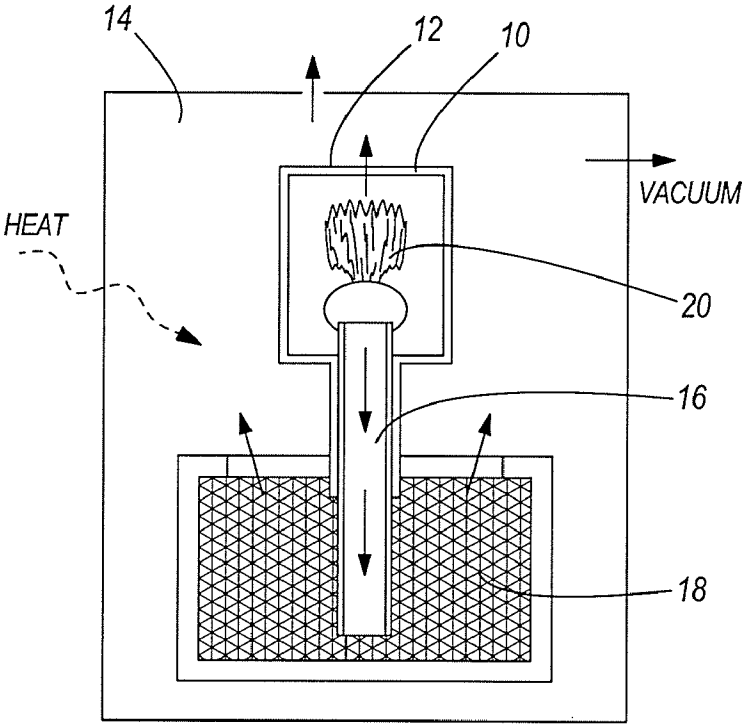

FIGS. 1A and 1B illustrate a casting process according to one embodiment of the invention. Embodiments of the invention provide a method of casting including one or more of the following steps: coating at least a portion of a mold 10 (e.g., any porous mold constructed of ceramic, sand, a refractory material, etc.) with a non-porous coating 12 (e.g., a glaze); placing the mold 10 in a chamber 14 capable of vacuum and pressure; placing a tube 16 in a material 18; applying an approximately equal vacuum to the tube 16 and the inside of the chamber 14; applying pressure to the chamber 14 to press the material 18 into a cavity 20 in the mold 10 while maintaining the vacuum in the tube 16; allowing the material 18 in the cavity 20 to cool; and removing the mold 10.

Some embodiments of the invention provide a method for casting metal and metal matrix composite components (among other materials). The method can provide a simple and low-cost means to apply a pressure gradient (e.g., greater than one atmosphere) to molten metal during the mold filling process. The mold can be filled under vacuum and beneficial pressure can be applied to the metal during filling and solidification. The mold can be held under isostatic compressive pressure during the casting process.

To improve the quality of castings (and metal matrix composites) and to reduce feature size, it can be beneficial to apply a vacuum to the mold and the mold cavity while applying pressure to the molten metal feed. The vacuum and pressure can be maintained during metal fill and metal freezing. The presence of gas in the cavity and the mold can lead to gas defects. The absence of "head" pressure on the metal can result in small features not filling due to metal surface tension.

Some embodiments of the invention provide a casting method that uses a glaze or non-porous coating on a portion of or the entire outer surface of the mold. The non-porous coating can be applied by dipping the mold in the coating, by spraying the coating onto the mold, and/or by brushing the coating onto the mold. The mold itself can be porous (e.g., ceramic) or non-porous (e.g., glass or silicone). The glaze or coating can create a non-porous barrier coating capable of transferring pressure to the outer surface of a mold from the adjacent atmosphere.

A first non-porous fill tube can be provided. The first non-porous fill tube can communicate between the mold cavity and the molten metal supply through the glaze or non-porous coating. In some embodiments, a second non-porous tube can communicate through the glaze or non-porous coating between a vacuum and the mold cavity (e.g., via mold ceramic porosity or via a filter or orifice in communication with the mold cavity). In other embodiments, a plurality of vacuum and/or fill tubes can be used. However, in some embodiments, the second non-porous tube is not necessary. In some embodiments, the second non-porous tube can be replaced by a window or opening in the non-porous coating that can allow the porous mold to communicate with the vacuum or low pressure.

Substantially equal gas pressure can be applied to the molten metal surface and outside of the mold, while a vacuum can be applied within the mold and barrier coating. The pressure gradient can move the molten metal into the mold cavity at a rate that can be controlled by the pressure gradient. Upon metal fill, higher pressures can be applied, placing the mold material under isostatic compressive load. The mold can be generally prevented from bursting, because substantially equal compression pressure is generally applied within the mold and on the outer surface. A steep pressure gradient can result in features smaller than approximately 0.1 mm filling. The pressure gradient can be beneficial during solidification as well, reducing solidification defects.

In some embodiments of the invention, the ceramic mold is not under tension, because pressure is applied substantially equally inside and outside during casting. In these embodiments, pressures higher than one atmosphere can be readily applied and the risk of the ceramic mold bursting is reduced. Some embodiments of the invention also provide a reduced risk of ceramic cracking with isostatic mold pressure.

According to one method of the invention, a ceramic mold can be constructed with the following features: a first non-porous tube can protrude from the mold cavity, through the outer surface of the mold; a second non-porous tube can protrude from the mold ceramic through the outer surface of the mold; and a glaze or non-porous coating can be applied to substantially the entire porous outer surface of the ceramic mold.

Also, the method can include processing casting performed according to the following steps: placing the mold in a chamber capable of vacuum and pressure; placing the first non-porous tube in molten metal; applying a substantially equal vacuum to the second non-porous tube and the inside of the chamber; and applying a pressure to the chamber to press metal into the cavity while maintaining a vacuum on the second non-porous tube. Metal can be pressed into the cavity, while a substantially equal gas pressure can be applied to the outer surface of the mold, creating an ideal compressive condition on the mold. Finally, the method can include allowing the metal to freeze and removing the ceramic as needed.

In one embodiment of the invention, the process can be performed outside of a chamber. A first fill tube can be covered with a thermally-reversible cap or left open. A vacuum can be applied to a second fill tube to establish a vacuum within the glaze barrier on the porous ceramic mold. The first fill tube can be placed in the molten material. The first fill tube cap can melt in order to allow atmospheric pressure to inject metal into the mold. In this embodiment, a chamber is not necessarily required.

In conventional casting processes, when a mold is under a vacuum, the metal enters the mold with a high velocity, but suddenly stops when the mold is filled. This results in a transfer of kinetic energy to the mold. In some embodiments of the invention, this impact can be reduced, prevented, or managed by having the mold under compression and/or controlling the velocity of the metal.

Embodiments of the invention are suitable for use in a class room setting, because many embodiments of the invention can be performed completely enclosed and processed remotely. This provides a safer demonstration of metal casting.

Embodiments of the invention can be used for a multitude of applications common for metal castings and metal matrix composites. The ability to cast features smaller than 0.1 mm can be used in the medical industry (e.g., for stents or implants) and in the jewelry industry. The aerospace, energy, military, medical, jewelry, automotive, and computing industries are all likely users of embodiments of the invention. Another likely use of embodiments of the invention is to manufacture any product in which high quality castings or metal matrix composites are needed, especially with ultrafine features.

In other embodiments of the invention, different types of barrier coatings can be used, such as silicone. Zero-gravity casting can be used in some alternative embodiments of the invention. Bi-metal castings can be constructed using some embodiments of the invention. In one embodiment of the invention, a secondary addition of a second phase can be used to enhance properties (e.g., to optimize lattice structures). For single crystal objects, embodiments of the invention can include casting viscous materials or slushy materials, such as metals between solidous and liquidous phases, and glasses, including metallic glasses.

Some embodiments of the invention have one or more of the following features. The casting of metal in a pre-heated mold can be subjected to near-uniform compressive loads throughout. In other embodiments, the mold is not pre-heated and a casting is produced by filling the mold before the metal freezes. A beneficial vacuum can be applied to a relatively high percentage of the metal casting surface through the ceramic porosity, approaching 100 percent in some cases. Metal can be introduced under pressure, and the pressure can exceed one atmosphere and potentially approaching pressures greater than 1000 PSI. Metal can be introduced into the mold cavity at a controlled rate, for example, ranging from kilograms per second to micrograms per second. Metal can be slowly introduced into a pre-heated ceramic mold, resulting in reduced risk of inclusions, gas defects, and mold damage. Casting in a pre-heated mold can allow mold filling with melts having a few degrees of superheat and potentially casting materials at temperatures below liquidous. Metal can be placed under pressure before or during solidification to fill extraordinary fine features, for example, smaller than 25 microns. A range of materials can be produced using methods of the invention, for example, lead, zinc, copper-based alloys, aluminum, ferrous alloys, nickel-based super alloys, glass, single crystals of metal, metal-matrix composites, viscous materials, etc. The material can be pre-loaded so that materials with a high viscosity can be cast. High viscosity materials loaded with reinforcement particles can be cast. Also, methods of the invention may prove to be a preferred method of casting reactive metals, such as chrome-cobalt alloys, titanium alloys and magnesium alloys. Methods of the invention can be combined with solid free-form fabrication patterns, leading to one or more of the following advantages: casting with reduced scrap, improved quality, extended minimum feature size, advanced alloys, and form complexity exceeding conventional casting processes.

In some embodiments of the invention, a hot isostatic pressing (HIP) process can be eliminated. The HIP process is conventionally used to reduce the porosity of a completed cast by introducing approximately 3,000 to 6,000 PSI around the cast.

The invention claimed is:

1. A method of casting comprising:

positioning a mold in a chamber, the mold having an exterior surface and an interior volume, a non-porous coating with respect to inert gases and vacuum applied to the exterior surface, and the interior volume being under vacuum;

positioning a material including at least one of metal and metal matrix composite in the same chamber with the mold;

coupling the interior volume of the mold to the material via a conduit;

applying pressure within the chamber to generate a pressure gradient between the interior volume and the chamber; and moving material upwards through the conduit into the interior volume of the mold according to the pressure gradient while compressive pressure is applied to the mold and the material within the chamber.

2. The method of claim 1 and further comprising maintaining the vacuum in the conduit while applying pressure within the chamber to move the material into the interior volume of the mold.

3. The method of claim 1 and further comprising allowing the material in the interior volume to cool and removing the mold.

4. The method of claim 1 and further comprising coating at least a portion of the mold with at least one of a glaze and a silicone.

5. The method of claim 1 and further comprising providing an opening in the non-porous coating and applying a vacuum to the opening and the chamber.

6. The method of claim 5 and further comprising maintaining the vacuum through the opening while applying pressure to the chamber to move the material into the interior volume of the mold.

7. The method of claim 1 and further comprising creating a porous mold constructed of at least one of ceramic, sand, and a refractory material.

8. The method of claim 1 and further comprising creating a non-porous mold constructed of at least one of glass and silicone.

9. The method of claim 1 and further comprising creating a pressure gradient between about one atmosphere and about 75 atmospheres.

10. The method of claim 1 and further comprising applying at least one of a vacuum and a pressure during solidification of the material in the mold.

11. The method of claim 1 and further comprising applying isostatic compressive pressure to the mold.

12. The method of claim 1 and further comprising providing a second conduit to communicate through the non-porous coating between a vacuum and the interior volume of the mold.

13. The method of claim 1 and further comprising controlling a rate of movement of the material into the mold by creating a pressure gradient.

14. The method of claim 13 and further comprising controlling a rate of movement of the material between kilograms per second and micrograms per second.

15. The method of claim 1 and further comprising providing a pressure gradient to create features less than about 0.1 millimeters in size.

16. The method of claim 15 and further comprising providing a pressure gradient to create features less than about 25 microns in size.

17. The method of claim 1 and further comprising applying a higher pressure while the material fills the interior volume of the mold.

18. The method of claim 1 and further comprising preventing the mold from cracking by creating a substantially equal compressive pressure within the interior volume of the mold and on the outer surface of the mold.

19. The method of claim 1 and further comprising preventing the mold from being under tension by applying a substantially equal pressure inside and outside the mold.

20. The method of claim 1 and further comprising preheating the mold.

21. The method of claim 1 and further comprising casting a material with a melting point having a few degrees of superheat.

22. The method of claim 1 and further comprising casting a material at a temperature below liquidus.

23. The method of claim 1 and further comprising providing a material including at least one of glass, lead, zinc, copper-based alloy, aluminum, ferrous alloy, nickel-based super alloy, a single crystal of metal, viscous metal, chrome-cobalt alloy, titanium alloy, magnesium alloy, and a high viscosity material with reinforcement particles.

24. The method of claim 1 and further comprising preloading the material with additional phases.

25. The method of claim 24 and further comprising preloading the material with reinforcement particles.

26. The method of claim 1 and further comprising creating a mold pattern using solid free-form fabrication.

27. The method of claim 1 and further comprising reducing porosity of a casting in order to eliminate a hot isostatic process.

28. The method of claim 1 and further comprising coating at least a portion of the mold with a non-porous coating having a thickness of up to about one millimeter.

29. The method of claim 1 and further comprising allowing the non-porous coating to penetrate into the mold.

30. The method of claim 1 and further comprising performing centrifugal casting.

31. A method of casting comprising:

providing a mold having an exterior surface and an interior volume, a non-porous coating with respect to inert gases and vacuum applied to the exterior surface;

providing a material including at least one of a metal and a metal matrix composite;

placing a first fill tube between the material and the interior volume of the mold;

placing a second fill tube through the non-porous coating and the mold between the interior volume of the mold and the atmosphere;

applying a vacuum to the second fill tube to establish a vacuum within the interior volume of the mold, thereby creating a pressure gradient between the interior volume and the atmosphere; and allowing atmospheric pressure to inject the material into the interior volume of the mold through the first fill tube.

32. The method of claim 31 and further comprising covering the first fill tube with a thermally-reversible cap and melting the cap in order to allow atmospheric pressure to inject the material into the mold.

33. The method of claim 31 and further comprising leaving the first fill tube open.

34. The method of claim 31 and further comprising allowing the material in the mold to cool and removing the mold.

35. The method of claim 31 and further comprising coating at least a portion of the mold with at least one of a glaze and a silicone.

36. The method of claim 31 and further comprising providing an opening in the non-porous coating and applying a vacuum to the opening and the interior volume of the mold.

37. The method of claim 31 and further comprising creating a porous mold constructed of at least one of ceramic, sand, and a refractory material.

38. The method of claim 31 and further comprising creating a non-porous mold constructed of at least one of glass and silicone.

39. The method of claim 31 and further comprising preheating the mold.

40. The method of claim 31 and further comprising casting a material with a melting point having a few degrees of superheat.

41. The method of claim 31 and further comprising casting a material at a temperature below liquidus.

42. The method of claim 31 and further comprising providing a material including at least one of glass, lead, zinc, copper-based alloy, aluminum, ferrous alloy, nickel-based super alloy, a single crystal of metal, viscous metal, chrome-cobalt alloy, titanium alloy, magnesium alloy, and a high viscosity material with reinforcement particles.

43. The method of claim 31 and further comprising preloading the material with additional phases.

44. The method of claim 43 and further comprising preloading the material with reinforcement particles.

45. The method of claim 31 and further comprising creating a mold pattern using solid free-form fabrication.

46. The method of claim 31 and further comprising coating at least a portion of the mold with a non-porous coating having a thickness of up to about one millimeter.

47. The method of claim 31 and further comprising allowing the non-porous coating to penetrate into the mold.

48. The method of claim 31 and further comprising performing centrifugal casting.

49. A method of casting comprising:

positioning a mold in a chamber, the mold including an exterior surface and an interior volume, the interior volume being evacuated;

positioning a material including at least one of metal and metal matrix composite in the same chamber, the material in communication with an interior of the mold via a conduit;

applying pressure within the chamber to move the material into the interior of the mold through the conduit; and maintaining substantially compressive pressure on the mold while the material moves into the interior of the mold, wherein the mold includes an interior surface and further comprising applying a non-porous coating on one of the exterior surface and the interior surface of the mold.

50. A method of casting comprising:

positioning a mold in a chamber, the mold including an exterior surface and an interior volume, the interior volume being evacuated;

positioning a material including at least one of metal and metal matrix composite in the same chamber, the material in communication with an interior of the mold via a conduit;

applying pressure within the chamber to move the material into the interior of the mold through the conduit; and maintaining substantially compressive pressure on the mold while the material moves into the interior of the mold, wherein the mold includes an interior surface and further comprising applying a porous coating to one of the exterior surface and the interior surface of the mold.

* * * * *